US007261262B2

(12) United States Patent
Dunson

(10) Patent No.: US 7,261,262 B2
(45) Date of Patent: Aug. 28, 2007

(54) BUCKET BRACE AND METHOD FOR USE

(75) Inventor: Jessie L. Dunson, Byhalia, MS (US)

(73) Assignee: DPS, LLC, Lookout Mountain, TN (US)

( * ) Notice: Subject to any disclaimer, the term of this patent is extended or adjusted under 35 U.S.C. 154(b) by 145 days.

(21) Appl. No.: 11/227,946

(22) Filed: Sep. 15, 2005

(65) Prior Publication Data

US 2007/0056979 A1 Mar. 15, 2007

(51) Int. Cl.
*A47G 23/02* (2006.01)

(52) U.S. Cl. ..... 248/154; 248/500; 248/213.2; 248/346.01; 248/310; 220/628; 220/629; 220/630; 366/349; 366/129

(58) Field of Classification Search ..... 248/154, 248/500, 213.2, 346.01, 310, 316.8, 346.03, 248/346.04, 346.06, 346.07, 346.5; 220/628–630; 366/349, 129; 108/139, 142; 312/319.9
See application file for complete search history.

(56) References Cited

U.S. PATENT DOCUMENTS

| | | | | |
|---|---|---|---|---|
| 1,818,400 | A * | 8/1931 | James et al. | 248/154 |
| 1,828,249 | A * | 10/1931 | Hammond | 248/154 |
| 2,006,944 | A | 7/1935 | Courtney | |
| 4,216,685 | A | 8/1980 | Taylor | |
| 4,877,208 | A * | 10/1989 | Kennard, Jr. | 248/146 |
| 5,150,804 | A | 9/1992 | Blanchet et al. | |
| 5,228,159 | A | 7/1993 | Gurka | |
| 5,232,188 | A | 8/1993 | Troncone | |
| 6,361,001 | B1 * | 3/2002 | Durand | 248/146 |
| 6,375,134 | B1 * | 4/2002 | Goldschmidt et al. | 248/154 |
| 6,464,184 | B1 * | 10/2002 | Lytle | 248/126 |
| 6,829,800 | B2 | 12/2004 | Roebuck | |
| 7,178,766 | B2 * | 2/2007 | Forshee et al. | 248/146 |
| 2003/0016586 | A1 * | 1/2003 | Williams | 366/349 |
| 2004/0021043 | A1 * | 2/2004 | Zagorsky | 248/146 |
| 2007/0076519 | A1 * | 4/2007 | Kesling | 366/129 |

* cited by examiner

*Primary Examiner*—Carl D. Friedman
*Assistant Examiner*—Michael McDuffie
(74) *Attorney, Agent, or Firm*—Baker, Donelson, Bearman, Caldwell & Berkowitz, PC; Micheline Kelly Johnson

(57) ABSTRACT

A bucket brace holds a bucket in place while the bucket's contents are mixed or stirred. The bucket brace prevents the bucket from spinning due to the mixing. The bucket brace is an assembly made up of four parts: a base, a foot pressure portion, a front support, and a rear support. A handle is provided for carrying the base. The front and rear supports are of semi-circular shape, and are made of rigid or semi-rigid material, as are the base and the foot pressure portion. The foot pressure portion and the base are integral, preferably both parts being formed from the same piece of material. The foot pressure portion and the rear support preferably have surface grip portions. The handle may be made of any suitable material, preferably the same rigid or semi-rigid material as the other parts of the bucket brace. A method of use for employing the brace to hold a bucket in place while stirring or mixing the contents of the bucket is also described whereby the user places a bucket in the brace and applies foot pressure to the foot pressure portion to prevent the bucket from spinning while the user stirs or mixes the bucket contents.

10 Claims, 2 Drawing Sheets

BUCKET BRACE AND METHOD FOR USE

BACKGROUND OF THE INVENTION

1. Field of the Invention

This invention relates generally to construction tools and in particular to a bucket brace tool and method for use of the same that enables a user to apply foot pressure against the bucket brace to prevent rotation of the bucket during stirring or mixing of the bucket's contents.

2. Description of the Background Art

The construction industry utilizes gypsum drywall taping compounds and pails of premixed plaster. Some drywall compounds must be mixed with water prior to application. Premixed plaster is supplied in 25 kg buckets in which cement must be mixed with the plaster before being applied as a patching and finishing compound. In both cases, a portable mixer having mixing paddles that rotate at approximately 400 to 600 rpm is used to mix the viscous or cementitious materials. When the mixer is activated in the materials in the bucket, the bucket tends to spin. To prevent the bucket from rotating, the construction worker must use his or her feet to hold the bucket still. Alternatively, a second worker may be employed to hold the bucket steady. Either technique is somewhat dangerous, as mixing in this manner may result in injury to the second worker or even to the first worker, due to strain on the worker's lower back and other muscles while attempting to maintain the awkward position required to both control the mixer and steady the bucket. In addition, if the worker holding the bucket is distracted or in any way relaxes his control of the bucket, then the bucket can spin rapidly and injure either the second worker, if there is one, or the single worker's lower legs by the concussion of the bucket onto the worker's hands or legs, respectively.

Alternatively, a worker can stand on the rim of a bucket that is sturdy enough and operate the power stirrer. While this generally keeps the bucket steady, this position is potentially dangerous in that the bucket could break or the worker could slip. Moreover, dirt from the bottom of the worker's boots can easily fall into the bucket contents from this position. If the bucket is not steadied in some manner prior to engaging the mixer with the contents of the bucket, the bucket will rotate in the same direction as the direction of mixing, and then will rapidly spin in an uncontrolled fashion. Spillage of the contents of the bucket will result.

Other inventions have addressed this problem, but they are all either inherently prone to tipping the bucket, bulky, or otherwise inconvenient.

U.S. Pat. No. 6,829,800 B2, issued Dec. 14, 2004 to Roebuck, provides a bucket grasp tool that attaches to a bucket handle and holds the bucket down by foot pressure applied to a tool, which is curved to extend from the bucket handle down to the perpendicular floor surface supporting the bucket. This device inherently applies pressure on one side of the bucket only, thus leaving the bucket unbalanced and vulnerable while additional forces are exerted on the bucket through the mixing of the bucket contents. In addition, this tool has a sharp edge and is limited to use on buckets that have handles. Moreover, its usefulness in buckets that are only partially filled is questionable, as even less stability is afforded when the weight of the bucket contents is significantly less than when a bucket is full.

U.S. Pat. No. 4,877,208, issued Oct. 31, 1989 to Kennard, Jr., is a support for a mixer bucket having a raised platform including a recess shaped to accommodate a mixer bucket. Gripping means are provided in the recess that engage against the bucket to maintain the bucket in position while the contents are being mixed. This device provides no support to the bucket other than at the base, and the design is inherently subject to the danger of tipping.

U.S. Pat. No. 5,150,804 to Blanchet, et al., issued Sep. 29, 1992, provides a pail, pail support, and coupling. The apparatus includes a pail, and a lid for closing the pail in a closing position, and for supporting the pail in a supporting and locking position. The pail has notches in the base of the pail. The lid has corresponding lugs for vertical interlocking and rotationally resistive engagement with the notches when the lid is in the supporting position. When the lid is in the supporting position, the lid supports the pail vertically and laterally, and the mating engagement of the lid and pail resists relative rotation between the lid and the pail. However, this notched design requires use of pails with mating notches, which are not commonly available.

U.S. Pat. No. 6,361,001 B1, issued Mar. 26, 2002 to Durand, is a container holder for mixing slurry material in a 2½ or 5 gallon bucket. The container holder is formed from a one-piece raised top portion having a centrally disposed aperture allowing insertion of a stirring paddle. Depending from the top portion are two legs that extend downwardly and span the entire height of the bucket to be mixed, with foot pads joined at the bottom of the legs extending outwardly therefrom, which allow an individual to stand on the foot pads during the mixing operation. This device is bulky, limits the ability of the worker to move the mixer while stirring the contents of a bucket, and requires the worker to use both feet to secure the bucket.

U.S. Pat. No. 5,232,188, issued Aug. 3, 1993 to Troncone, provides a jig for use in supporting a pail during a mixing operation to be carried out within the pail. It includes a support ring which is distorted into an elliptical condition, thus relying on the interfitment of two members of elliptical form to prevent rotation of the pail relative to the jig. This device is formed of plastic materials to facilitate the intended distortion that provides frictional restraint against rotation of the pail, and thus is subject to breakage under the tremendous strain that the design and materials will experience during use.

There is thus a great need in the art for a stable, simple, and portable device for holding buckets in place while mixing or stirring materials in the buckets.

SUMMARY OF THE INVENTION

Accordingly, it is the primary object of the present invention to provide a bucket brace that is capable of supporting a bucket and preventing it from spinning around when its contents are mixed together.

It is another object of the present invention to provide a device that enhances workplace safety, reduces loss due to spillage and cleanup time, and reduces physical strain on workers.

It is the further object of the present invention to provide a method for using a bucket brace apparatus to prevent buckets from spinning while their contents are being mixed together.

Another object of the present invention is to provide both a method and a bucket brace apparatus for preventing spinning of buckets during contents mixing that is readily and economically manufactured.

One more object of the present invention is to function simply by dropping a bucket into the brace and engaging the brace against the bucket by application of one foot's pressure to the brace.

An additional objective of the present invention is to be able to be used with buckets that are either only partially filled and/or do not have a handle.

An auxiliary object of the present invention is to be formed with a high friction patterned surface provided on the foot pressure portion and interior surfaces for extra traction.

These and other objects of the present invention are fulfilled by providing a bucket brace comprising a base, a foot pressure portion, a front support, a rear support, and a handle. The bucket brace keeps the bucket from spinning while mixing the bucket's contents, normally viscous fluids such as drywall compounds, or plaster, in the bucket with a mixing device such as a mechanical mixer. The front support and rear support are preferably semicircular shaped and are preferably made of rigid material such as steel or other metal, polyvinylchloride (PVC) or other plastic, fiberglass, or silicone, or of semi-rigid material such as rubber. The base and foot pressure portion are preferably flat and integrally formed such that the foot pressure portion is formed by applying a bend to the material, which preferably is made of rigid material such as such as steel or other metal, polyvinylchloride (PVC) or other plastic, fiberglass, or silicone, or of semi-rigid material such as rubber. Alternatively, the base and foot pressure portion may be hinged together or otherwise movably attached. The foot pressure portion preferably is provided with a front grip surface that is flat. It is preferably made of flexible material such as rubber. Similarly, the front and rear supports are preferably provided with a rear grip surface preferably made of flexible material such as rubber and may be flat and follow the curvature of the supports. Alternatively, the grip surfaces may be formed of sand or other abrasive adhered with an adhesive. The grip surfaces cover portions of the foot pressure portion and the front and rear support, being interconnected with glue or other bonding agent.

The handle may be made of any material, preferably the same rigid or semi-rigid material as the other parts of the bucket brace.

Additionally, these and other objects of the present invention are fulfilled by a method for preventing the spinning of a bucket while stirring its contents, the method comprising the steps of operatively inserting a bucket into a bucket brace; applying foot pressure to a foot pressure portion of the bucket brace; and stirring or mixing the bucket contents.

An advantage of the present invention is to prevent a bucket from spinning while its contents are being mixed together.

Another advantage of the present invention is to help workers avoid physical strain and the dangers associated with standing on top of a bucket.

An additional advantage of the present invention is to function simply, by applying foot pressure to a bucket dropped into the brace, and safely, without any danger of the bucket tipping in the direction in which foot pressure is being applied.

A final advantage of the present invention is that it can be manufactured inexpensively.

Further scope of the applicability of the present invention will become apparent from the detailed description given hereinafter. However, it should be understood that the detailed description and specific examples, while indicating preferred embodiments of the invention, are given by way of example and illustration only since various changes and modifications within the spirit and scope of the invention will become apparent to those skilled in the art from this detailed description.

BRIEF DESCRIPTION OF THE DRAWINGS

The present invention will become more fully understood from the detailed descriptions given hereinbelow and the accompanying drawings which are given by way of illustration only, and thus are not limitative of the present invention, and wherein.

DETAILED DESCRIPTION OF THE PREFERRED EMBODIMENTS

Figure 1:
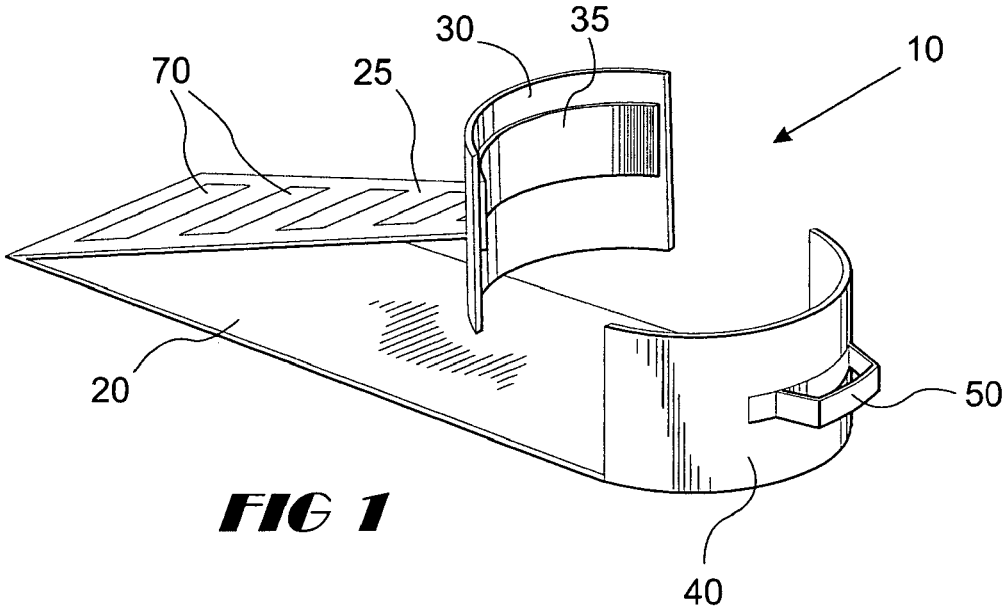
FIG. 1 is a side plan view of a bucket brace constructed in accordance with the present invention.
Figure 2:
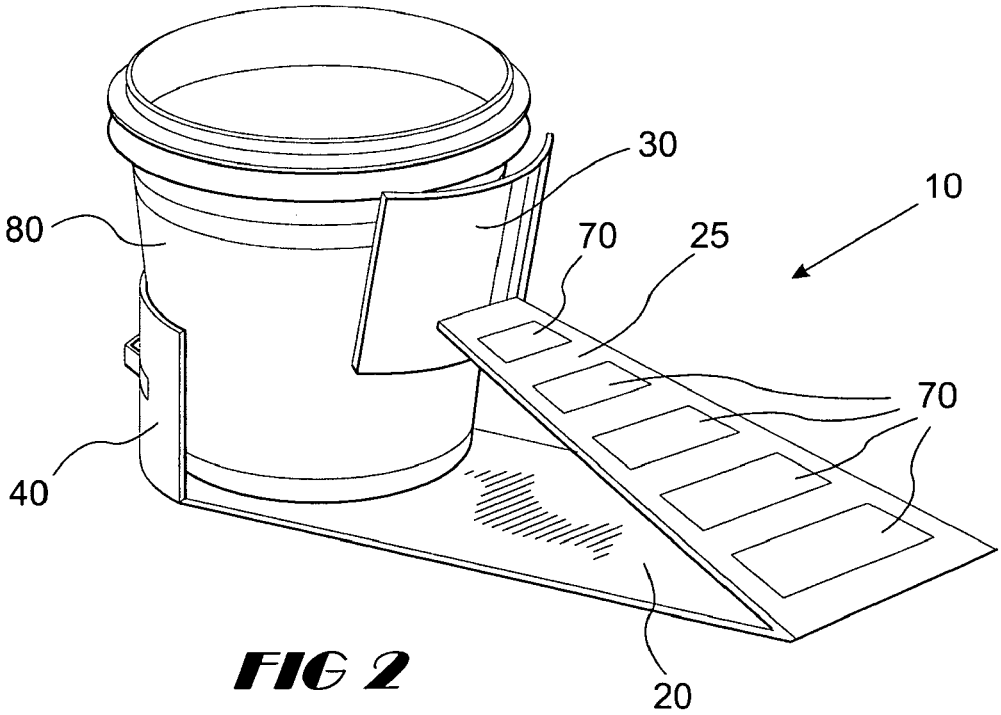
FIG. 2 is a side plan view of a bucket brace constructed in accordance with the present invention, with a bucket inserted between the bucket brace's front and rear supports.

Referring in detail to the drawings and with particular reference to FIGS. 1 and 2, a bucket brace 10 for holding down a bucket 80 securely to prevent rotation while a mechanical mixer is used to mix a viscous fluid in the bucket is illustrated. A bucket brace 10 has a base 20 and foot pressure portion 25, which preferably are fabricated from an elongated piece of rigid material such as steel or other metal, polyvinylchloride (PVC) or other plastic, fiberglass, or silicone, or of semi-rigid material such as rubber, that is folded. Alternatively, a hinge or hinges or other device could be used to achieve the relative placement of the base and foot pressure portion. The foot pressure portion 25 has front support 30 attached, preferably perpendicularly, to its unfolded or unhinged end. Both foot pressure portion 25 and front support 30 may be provided with a high friction patterned material 35 to provide extra traction. The unfolded end of base 20 is fitted with rear support 40. Front support 30 and rear support 40 are of semi-circular shape, and are preferably made of the same rigid or semi-rigid material as are base 20 and foot pressure portion 25. Rear support 40 preferably is fitted with the same traction-enhancing high friction patterned material 35 that may be adhered to front support 30 and foot pressure portion 25. The outer surface of rear support 40 is preferably fitted with a handle 50, which may be made of any material, but preferably the same rigid or semi-rigid material as the other parts of the bucket brace.

Figure 3:
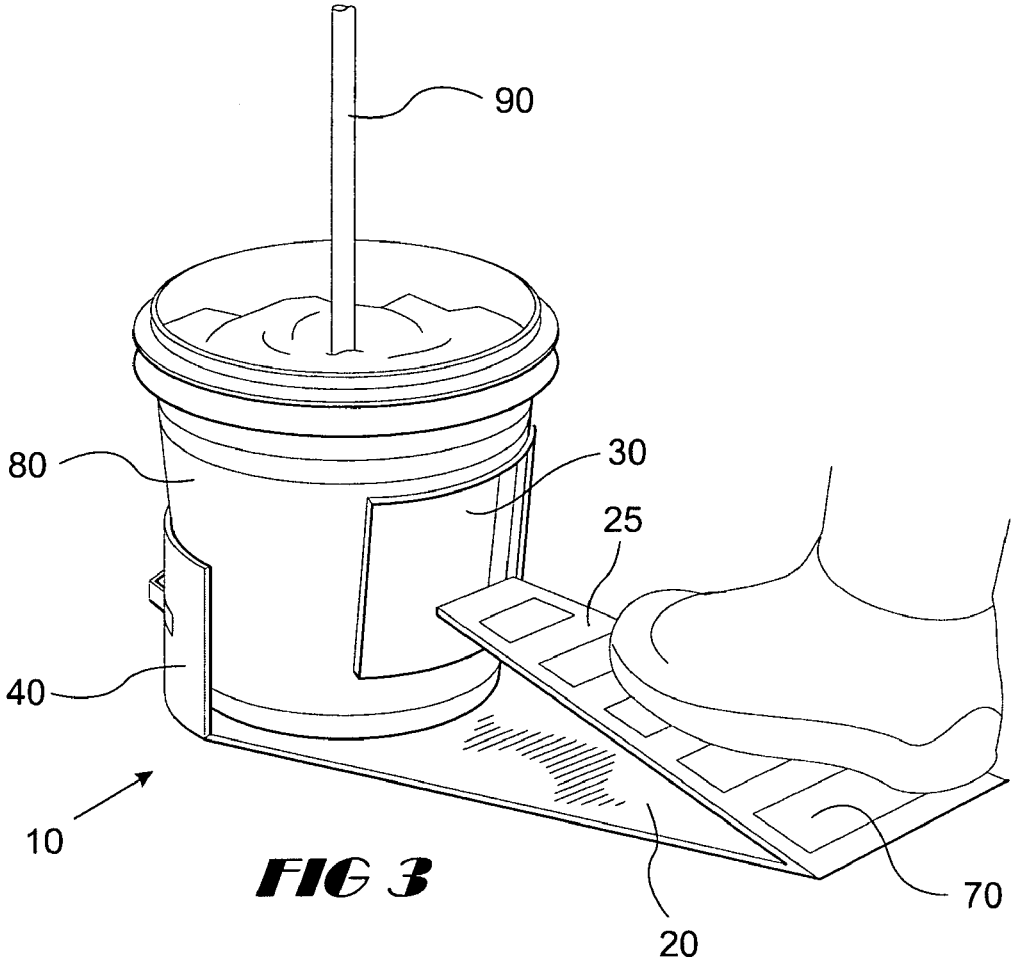
FIG. 3 is a side plan view of the preferred embodiment of the invention shown holding down a bucket during mixing.
Figure 4:
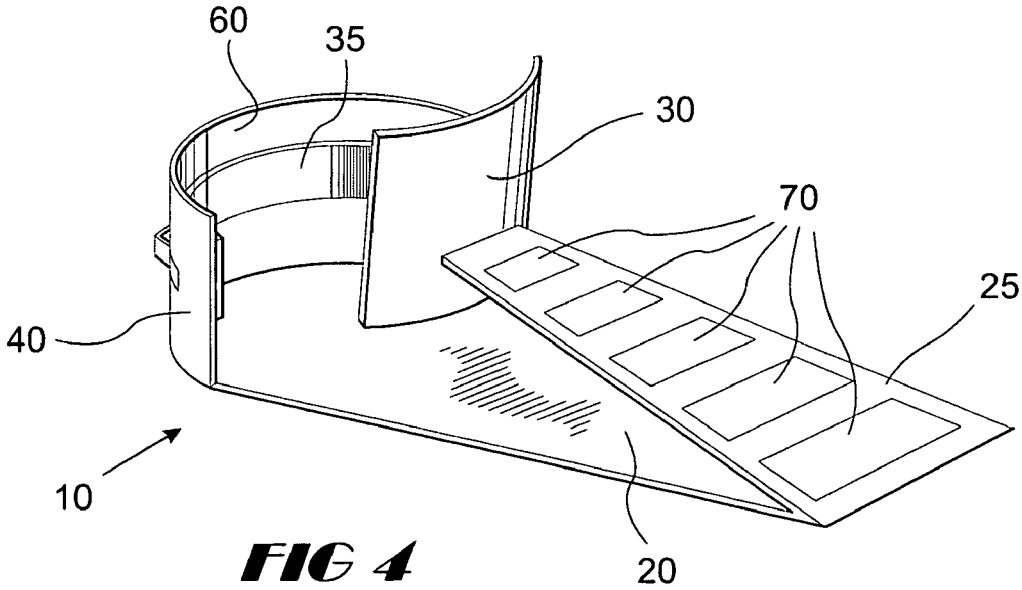
FIG. 4 is a side plan view of the preferred embodiment of the invention.

FIG. 3 shows a bucket 80 of sheet rock or other viscous fluid compound resting on base 20 and fitting snugly between rear grip surface 60 on rear support 40 and foot pressure traction surface 70 on front support 30. Rear grip surface 60 may be formed by an abrasive material, but is preferably fabricated from the same traction-enhancing high friction patterned material that may be adhered to front support 30 and foot pressure portion 25.

In operation, the bucket brace 10 for spin-resistant mixing is used on a bucket 80, as seen in FIG. 3, while mixing viscous fluids in bucket with a mechanical mixer such as a drill and paddle. FIG. 3 shows a worker applying foot pressure to foot pressure portion 25 and front pressure traction surfaces 70 to hold bucket 80 steady and prevent it from spinning while stirring the contents of bucket 80 with a mixer 90. Bucket 80 may be any size bucket as bucket brace 10 may be built to size. Thus, bucket brace 10 may be manufactured to fit the commonly available one-gallon bucket, five-gallon bucket, or ten-gallon bucket.

Bucket brace 10 may be made of ⅛ inch steel plate. Rear support 40 may be bent on a 5¼ inch radius and welded on the bucket-accepting face of base 20. A five-gallon sheet rock compound bucket is also a 5¼ inch radius.

Rear support 40 may be a solid, curved piece of material, or may have grooves or channels cut into the upper portion of rear support 40 such that a crenellated effect is achieved.

The invention being thus described, it will be obvious that the same may be varied in many ways. Such variations are not to be regarded as a departure from the spirit and scope of the invention and all such modifications as would be obvious to one skilled in the art were intended to be included within the scope of the following claims.

What is claimed is:

1. A bucket brace comprising:

a base having a semi-circular shaped distal end, and a bent proximal end;

a semi-circular shaped rear support attached to the distal end of the base;

a foot pressure portion formed from the bent proximal end portion of the base, having an unbent distal end and adapted for receiving a foot of a user to apply pressure to the brace and hold down the bucket on the base; and a handle affixed to the rear support.

2. The bucket brace of claim 1, further comprising:

a front support having a semi-circular shape and affixed to the distal end of the front pressure portion.

3. The bucket brace of claim 1, wherein the bucket base and foot pressure portion are fabricated from an elongated strip of rigid material.

4. The bucket brace of claim 2, wherein the bucket base and foot pressure portion are fabricated from an elongated strip of rigid material.

5. The bucket brace of claim 1, wherein a high friction surface is attached to the front pressure portion.

6. The bucket brace of claim 2, wherein a high friction surface is attached to the front pressure portion.

7. The bucket brace of claim 1, wherein a high friction surface is attached to the rear support.

8. The bucket brace of claim 2, wherein a high friction surface is attached to the rear support.

9. The bucket brace of claim 1, wherein a high friction surface is attached to the base.

10. The bucket brace of claim 2, wherein a high friction surface is attached to the base.

* * * * *